US011490467B2

(12) United States Patent
Liu

(10) Patent No.: US 11,490,467 B2
(45) Date of Patent: Nov. 1, 2022

(54) ELECTROMAGNETIC INDUCTION HEATER

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 358 days.

(21) Appl. No.: 16/745,298

(22) Filed: Jan. 16, 2020

(65) Prior Publication Data

US 2021/0100075 A1 Apr. 1, 2021

(30) Foreign Application Priority Data

Sep. 27, 2019 (CN) ..... 201910920805.0

(51) Int. Cl.
*H05B 6/04* (2006.01)
*H05B 6/10* (2006.01)
*H05B 6/36* (2006.01)

(52) U.S. Cl.
CPC ..... *H05B 6/04* (2013.01); *H05B 6/101* (2013.01); *H05B 6/36* (2013.01)

(58) Field of Classification Search
CPC ... H05B 6/10; H05B 6/04; H05B 6/36; H05B 6/101
See application file for complete search history.

(56) References Cited

U.S. PATENT DOCUMENTS

2018/0020728 A1* 1/2018 Alarcon ..... A61M 15/06 392/404

FOREIGN PATENT DOCUMENTS

CN 107232646 B * 9/2019 ..... A24F 47/008

* cited by examiner

*Primary Examiner* — Thien S Tran
(74) *Attorney, Agent, or Firm* — Matthias Scholl P.C.; Matthias Scholl

(57) ABSTRACT

An electromagnetic induction heater, including: a first cover plate; an inductive coil; a housing; a glass pipe; a second cover plate; a first control plate; a second control plate; a power button; a first baffle plate; a pair of electrodes; a third cover plate; a battery; a support frame; a battery connector; a spring; and a second baffle plate. The pair of electrodes is disposed on the support frame. The first baffle plate is disposed on the pair of electrodes and is fixed on the support frame. The spring butts against the battery connector. The spring and the battery connector are disposed in one end of the support frame. The second baffle plate is directly connected to the spring and fixed on the one end of the support frame. The support frame is disposed in the housing. The inductive coil is disposed on the first control plate.

1 Claim, 3 Drawing Sheets

ELECTROMAGNETIC INDUCTION HEATER

CROSS-REFERENCE TO RELAYED APPLICATIONS

Pursuant to 35 U.S.C. § 119 and the Paris Convention Treaty, this application claims foreign priority to Chinese Patent Application No. 201910920805.0 filed Sep. 27, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electromagnetic induction heater.

Conventional electric heaters include electric heating coils.

SUMMARY

The disclosure provides an electromagnetic induction heater.

The electromagnetic induction heater comprises a first cover plate; an inductive coil; a housing; a glass pipe; a second cover plate comprising a through hole; a first control plate; a second control plate; a power button; a first baffle plate; a pair of cup-shaped electrodes; a third cover plate; a battery; a support frame; a battery connector; a spring; and a second baffle plate.

The pair of cup-shaped electrodes is disposed on the support frame; the first baffle plate is disposed on the pair of cup-shaped electrodes and is fixed on the support frame; the spring butts against the battery connector; the spring and the battery connector are disposed in one end of the support frame; the second baffle plate is directly connected to the spring and fixed on the one end of the support frame; the support frame is disposed in the housing; the inductive coil is disposed on the first control plate; the first control plate is disposed on the second control plate; the inductive coil, the first control plate, and the second control plate are disposed in the housing; the second control plate comprises positive and negative electrodes connected to the pair of cup-shaped electrodes; the glass pipe is disposed in the inductive coil and communicates with the through hole of the second cover plate; the battery is disposed in the support frame; the power button is disposed on the second cover plate; the first cover plate is disposed on one end of the housing; the second cover plate is disposed on the housing to cover the inductive coil, and the third cover plate is disposed on the housing to cover the battery.

DETAILED DESCRIPTION

To further illustrate, embodiments detailing an electromagnetic induction heater are described below. It should be noted that the following embodiments are intended to describe and not to limit the disclosure.

Figure 1:
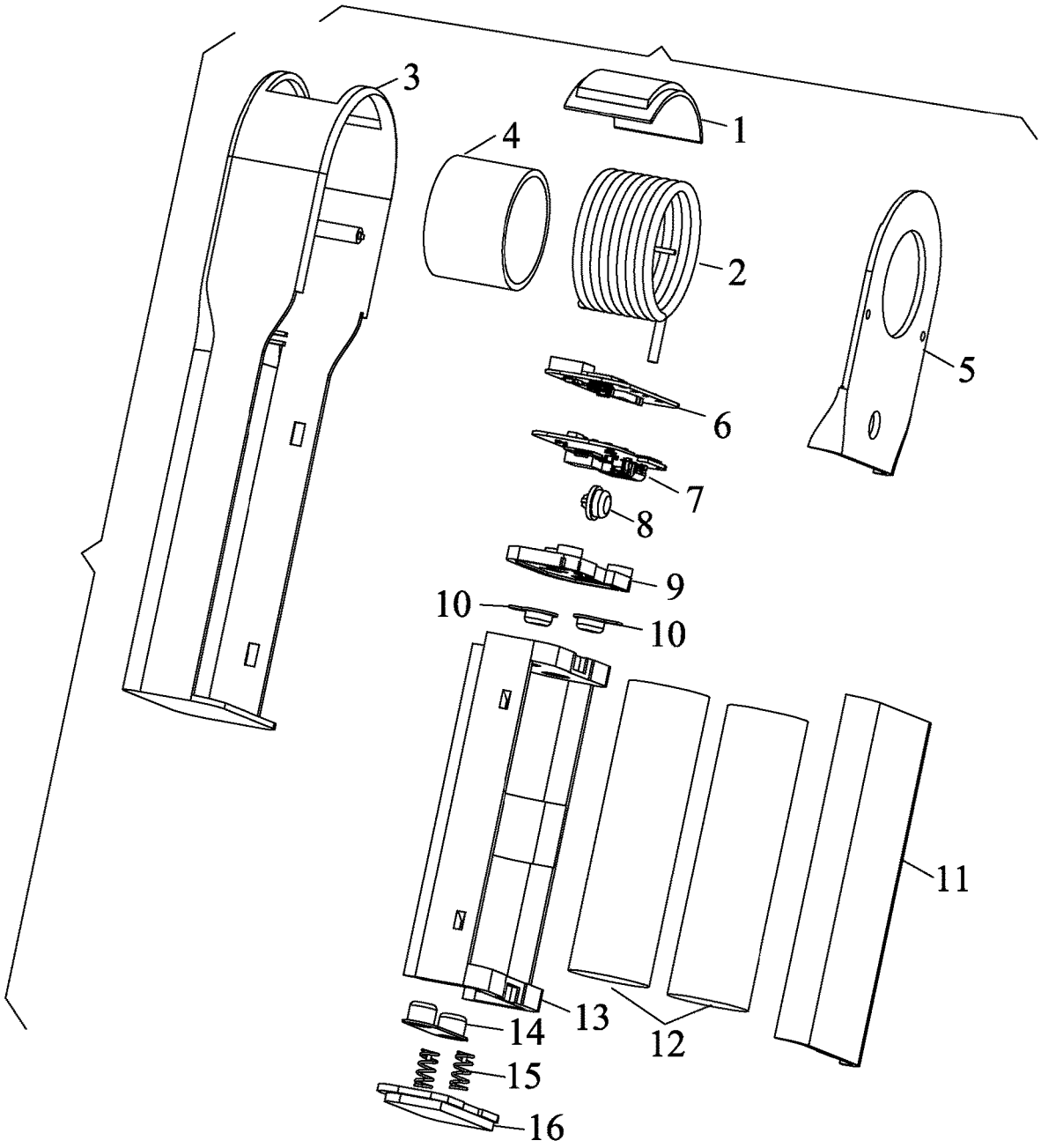
FIG. 1 is an exploded view of an electromagnetic induction heater according to one embodiment of the disclosure.
Figure 2:
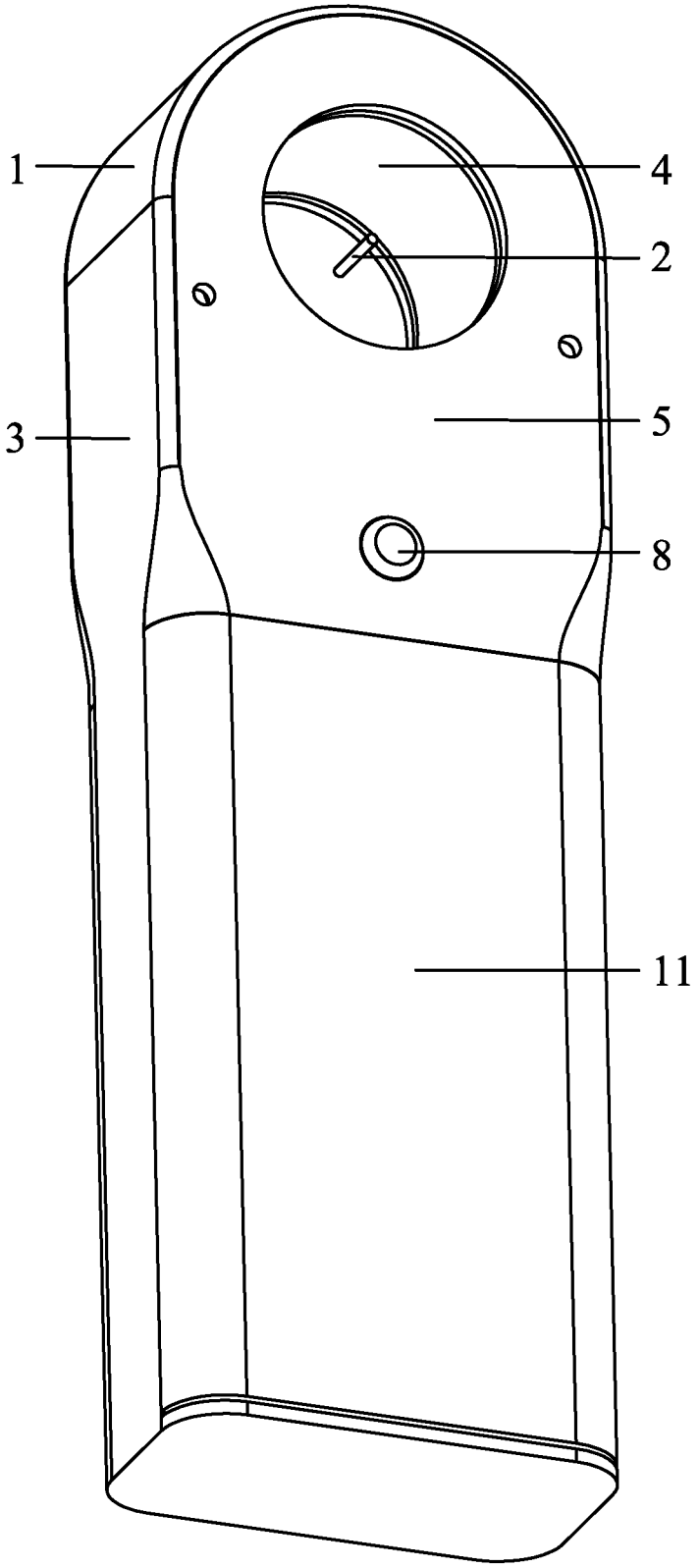
FIG. 2 is a stereogram of an electromagnetic induction heater according to one embodiment of the disclosure.
Figure 3:
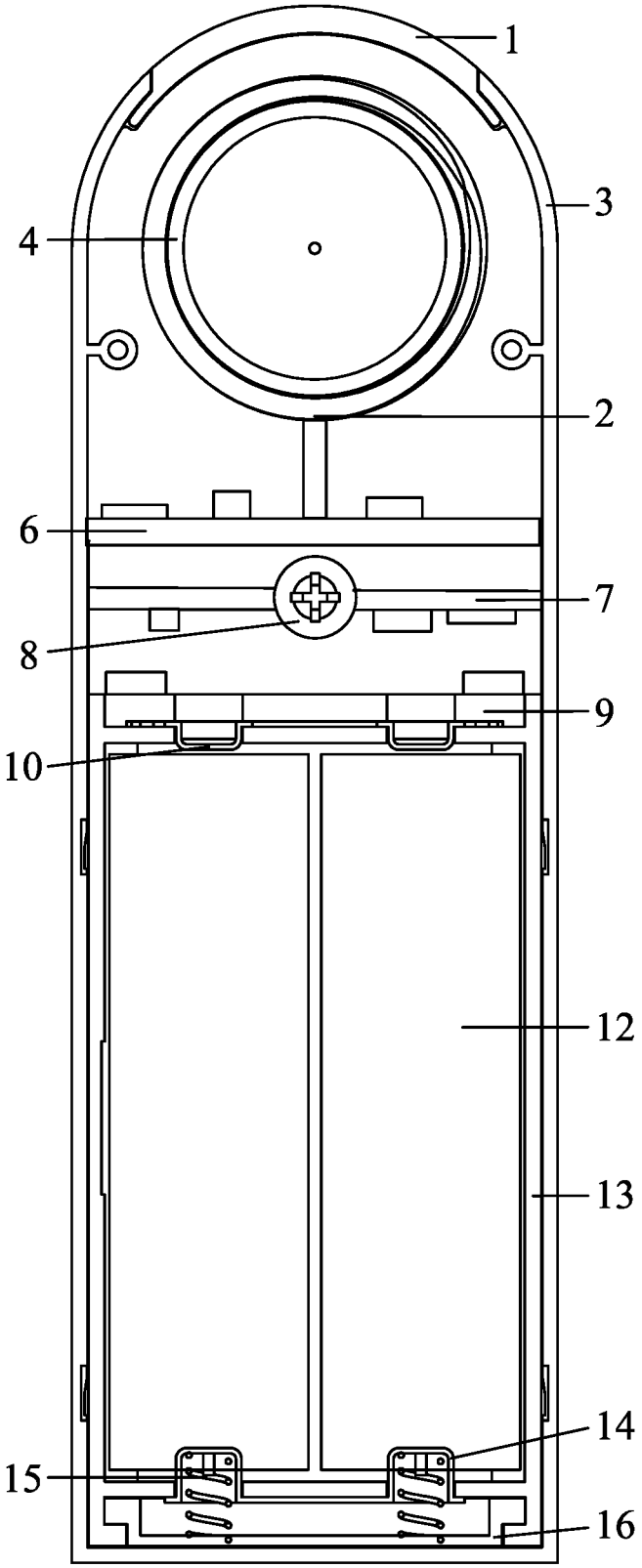
FIG. 3 is a sectional view of an electromagnetic induction heater according to one embodiment of the disclosure.

As shown in FIGS. 1-3, an electromagnetic induction heater comprises a first cover plate 1; an inductive coil 2; a housing 3; a glass pipe 4; a second cover plate 5 comprising a through hole; a first control plate 6; a second control plate 7; a power button 8; a first baffle plate 9; a pair of cup-shaped electrodes 10; a third cover plate 11; a battery 12; a support frame 13; a battery connector 14; a spring 15; and a second baffle plate 16.

The pair of cup-shaped electrodes 10 is disposed on the support frame 13; the first baffle plate 9 is disposed on the pair of cup-shaped electrodes 10 and is fixed on the support frame 13; the spring 15 butts against the battery connector 14; the spring 15 and the battery connector 14 are disposed in one end of the support frame 13; the second baffle plate 16 is directly connected to the spring 15 and fixed on the one end of the support frame 13; the support frame 13 is disposed in the housing 3; the inductive coil 2 is disposed on the first control plate 6; the first control plate 6 is disposed on the second control plate 7; the inductive coil 2, the first control plate 6, and the second control plate 7 are disposed in the housing 3; the second control plate 7 comprises positive and negative electrodes connected to the pair of cup-shaped electrodes 10; the glass pipe 4 is disposed in the inductive coil 2 and communicates with the through hole of the second cover plate 5; the battery 12 is disposed in the support frame 13; and the power button 8 is disposed on the second cover plate 5; the first cover plate 1 is disposed on one end of the housing 3; the second cover plate 5 is disposed on the housing 3 to cover the inductive coil 2, and the third cover plate 11 is disposed on the housing 3 to cover the battery 12.

In this embodiment, two batteries are provided and are serially connected to each other. The two serially connected batteries can produce 8.4 V voltage. The DC voltage and current is processed by the alternating circuit of the first control plate 6 and the second control plate 7 to produce high frequency alternating voltage and current, which are further amplified to form high power and output for the heater to work. The output alternating current will generate the induced magnetic field and form eddy current in the inductance coil 2. A metal carrier to be heated passes through the through hole of the second cover plate 5 and is placed in the glass pipe 4. In use, the power button 8 is pressed to start the heater, and an induced magnetic field is formed in the inductive coil 2, and the metal carrier is heated through the electromagnetic induction effect.

It will be obvious to those skilled in the art that changes and modifications may be made, and therefore, the aim in the appended claims is to cover all such changes and modifications.

What is claimed is:

1. A device, comprising:

1) first cover plate;
2) an inductive coil;
3) a housing;
4) a glass pipe;
5) a second cover plate comprising a through hole;
6) a first control plate;
7) a second control plate;
8) a power button;
9) a first baffle plate;
10) a pair of cup-shaped electrodes;
11) a third cover plate;
12) a battery;
13) a support frame;

14) a battery connector;

15) a spring; and 16) a second baffle plate;

wherein:

the pair of cup-shaped electrodes is disposed on the support frame;

the first baffle plate is disposed on the pair of cup-shaped electrodes and is fixed on the support frame;

the spring butts against the battery connector; the spring and the battery connector are disposed in one end of the support frame; the second baffle plate is directly connected to the spring and fixed on the one end of the support frame; the support frame is disposed in the housing;

the inductive coil is disposed on the first control plate; the first control plate is disposed on the second control plate; the inductive coil, the first control plate, and the second control plate are disposed in the housing;

the second control plate comprises positive and negative electrodes connected to the pair of cup-shaped electrodes; the glass pipe is disposed in the inductive coil; the glass pipe is empty for accommodating a metal carrier and comprises a pipe end that is open and that is connected to the through hole of the second cover plate; the battery is disposed in the support frame; and the power button is disposed on the second cover plate; the first cover plate is disposed on one end of the housing; the second cover plate is disposed on the housing to cover the inductive coil, and the third cover plate is disposed on the housing to cover the battery.

* * * * *